US006729782B2

(12) United States Patent
Ichitani et al.

(10) Patent No.: US 6,729,782 B2
(45) Date of Patent: May 4, 2004

(54) WIRE DOT PRINTER HEAD

(75) Inventors: Tetsuro Ichitani, Mishima (JP); Yasunobu Terao, Tagata-gun (JP); Takahiro Kawaguchi, Mishima (JP); Keishi Tsuchiya, Tagata-gun (JP); Takeshi Okui, Mishima (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/229,014

(22) Filed: Aug. 28, 2002

(65) Prior Publication Data

US 2004/0042834 A1 Mar. 4, 2004

(51) Int. Cl.[7] ..... B41J 2/275
(52) U.S. Cl. ..... 400/124.22; 400/124.23
(58) Field of Search ..... 400/124.22, 124.23

(56) References Cited

U.S. PATENT DOCUMENTS

| | | | | | |
|---|---|---|---|---|---|
| 3,729,079 | A | * | 4/1973 | Zenner et al. | 400/124.17 |
| 4,674,896 | A | * | 6/1987 | Yasunaga et al. | 400/124.2 |
| 4,802,781 | A | | 2/1989 | Sheerer | 400/124 |
| 5,141,341 | A | * | 8/1992 | Koyama et al. | 400/124.11 |
| 5,451,992 | A | * | 9/1995 | Shimomura et al. | 347/45 |

FOREIGN PATENT DOCUMENTS

| | | | | |
|---|---|---|---|---|
| JP | 54-24115 | | 2/1979 | |
| JP | 06286169 | A * | 10/1994 | B41J/2/28 |
| JP | 2958010 | | 7/1999 | |
| JP | 2000-343733 | | 12/2000 | |

OTHER PUBLICATIONS

Machine translation of JP 06286169 from Japanese Patent Office website.*

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

In the wire dot printer head of the present invention, there is provided an armature stopper against which an armature having pivoted from a printing position to a stand-by position comes into abutment, the armature stopper being formed by bonding an elastic plate and a hard plate with each other into an integral combination and thereafter punching the integral combination from the hard plate side. By this punching work the armature stopper is warped so that the hard plate side is convex in shape. With this warp, when the armature having pivoted to the stand-by position comes into abutment against the armature stopper, the armature stopper deflects in a direction to eliminate the warp. With this deflecting motion, an impact force induced upon mutual abutment of the armature and the armature stopper is diminished and deformation or chipping of the hard plate are suppressed, further, the durability of the armature stopper is improved and the printing accuracy is kept high over a long period.

18 Claims, 4 Drawing Sheets

WIRE DOT PRINTER HEAD

BACKGROUND OF THE INVENTION

1. Field of the Invention

The present invention relates to a wire dot printer head provided in a wire dot printer and more particularly to a wire dot printer head having an armature stopper against which an armature comes into abutment when it has pivoted from a printing position to a stand-by position.

2. Description of the Background Art

Heretofore there has been known a wire dot printer head wherein an armature with printing wire connected thereto is moved pivotally between a printing position and a stand-by position and a tip of the wire is caused to strike against printing paper when the armature is pivoted to the printing position, to effect printing.

Such a wire dot printer has an armature stopper against which an armature comes into abutment when it has pivoted from the printing position to the stand-by position. By provision of the armature stopper, it is possible to absorb a shock induced when the armature has pivoted to the stand-by position, thereby suppress the rebound of the armature and prevent the occurrence of such inconveniences as double striking caused by rebound and ribbon hooking. As an example of the armature stopper there is known a structure in which an elastic sheet made of rubber and a stainless steel plate are superimposed one on the other. The armature stopper is disposed in a direction in which the armature when pivoted to the stand-by position comes into abutment against the stainless steel plate. Such a stainless steel plate is formed so that its surface for abutment against the armature is flat.

However, with the recent tendency to a higher printing speed and a higher printing pressure, the impact force induced when the armature having pivoted to the stand-by position comes into abutment against the armature stopper is becoming more and more strong.

With such an increase of the impact force, the portion of the stainless steel plate as part of the armature stopper which portion comes into abutment against the armature is chipped or deformed, with consequent change in the printing stroke of the armature, occurrence of variations in print timing and printing pressure for each wire, and deterioration of the print quality.

Further, the plate may be damaged with the impact force induced upon abutment of the armature against the armature stopper, and if broken plate pieces scatter, the wire dot printer head may be heavily damaged.

SUMMARY OF THE INVENTION

Accordingly, it is an object of the present invention to suppress chipping or deformation of a hard plate of an armature stopper for abutment against an armature when the armature having pivoted from a printing position to a stand-by position comes into abutment against the armature stopper, and thereby improve the durability of the armature stopper.

It is another object of the present invention to prevent an armature from striking against burrs even when a hard plate which constitutes an armature stopper is burred in the course of fabrication of the armature stopper, and prevent cracking or the like of the armature and the hard plate caused by striking of the armature against the burrs.

It is a further object of the present invention to prevent scattering of broken hard plate pieces even when a hard plate which constitutes an armature stopper is broken upon abutment thereof against an armature.

The above objects of the present invention are achieved by a novel wire dot printer head according to the present invention.

In the novel wire dot printer head of the present invention, an armature stopper against which an armature having pivoted from a printing position to a stand-by position comes into abutment is formed by punching an integrally bonded laminate of an elastic plate and a hard plate, the punching being carried out from the hard plate side to warp the armature so that the hard plate side is convex in shape.

BRIEF DESCRIPTION OF THE DRAWINGS

A more complete understanding of the present invention and many associated advantages will be obtained from a reading and better understanding of the following detailed description when the same is read in connection with the accompanying drawings.

DETAILED DESCRIPTION OF THE PREFERRED EMBODIMENTS

An embodiment of the present invention will be described hereinunder with reference to FIGS. 1 to 5.

Figure 1:
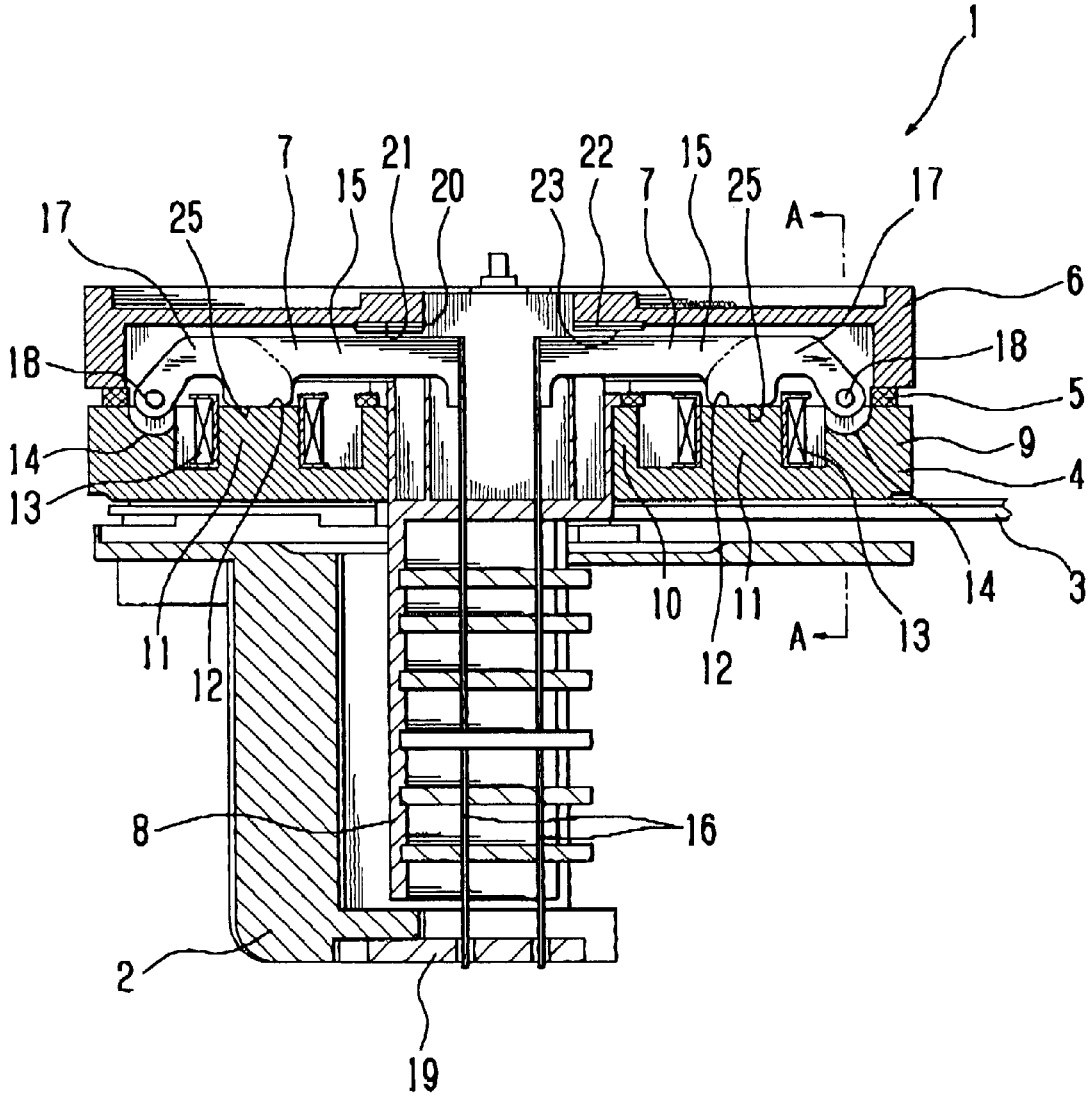
FIG. 1 is a front view in central vertical section of a wire dot printer head according to the present invention.
Figure 2:
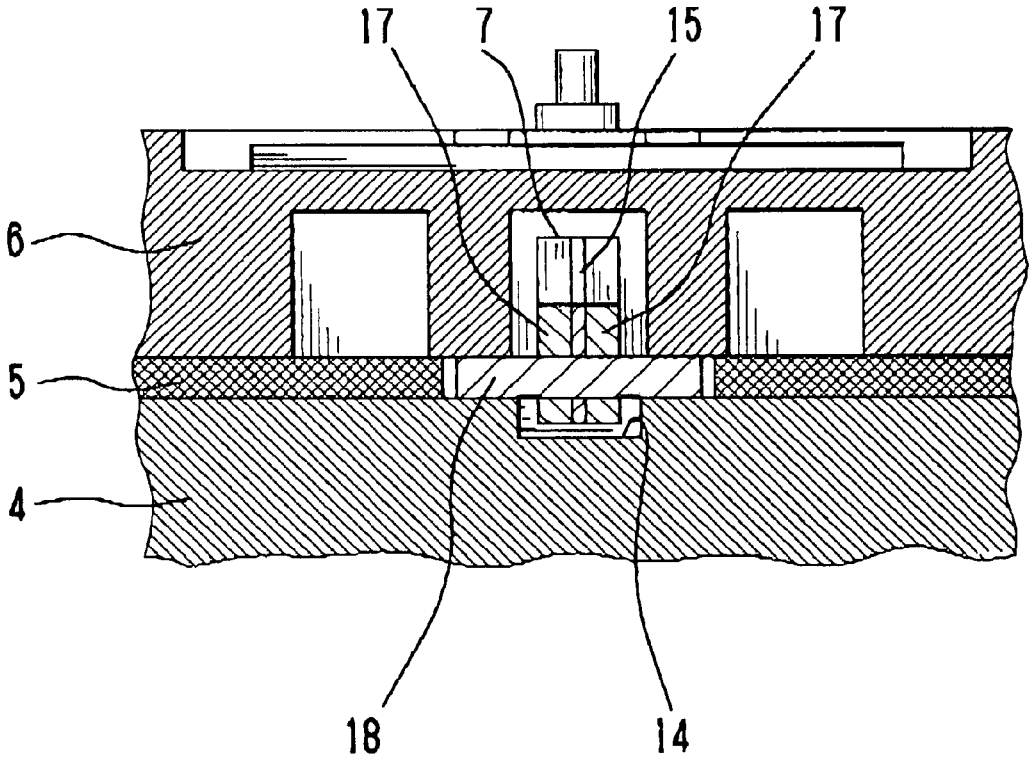
FIG. 2 is a partial side view in vertical section taken on line A—A in FIG. 1 for explaining an armature support structure.

First, with reference to FIG. 1, a description will be given about the entire construction of a wire dot printer head 1 embodying the invention. The wire dot printer head 1 comprises a front case 2, a circuit board 3, a yoke 4, an armature spacer 5, a rear case 6, plural armatures 7, and a wire guide 8. The front case 2 and the rear case 6 are coupled together with use of mounting screws (not shown), and the circuit board 3, yoke 4, armature spacer 5, armatures 7, and wire guide 8 are held between the front case 2 and the rear case 6. The plural armatures 7 are arranged radially.

The yoke 4, which is formed of a magnetic material, has a cylindrical portion 9 on an outer periphery side and a cylindrical portion 10 on an inner periphery side, with plural cores 11 being formed between the cylindrical portions 9 and 10. The cores 11 have pole faces 12 formed at one axial end of the yoke 4. Coils 13 are mounted on outer peripheries of the cores 11. In an upper surface of the outer periphery-side cylindrical portion 9 of the yoke 4 are formed recesses 14 correspondingly to the cores 11. The number of the cores 11, that of the recesses 14, and that of the armatures 7 are the same, and the armatures 7 are arranged in an opposed relation to the cores 11 and recesses 14.

The armatures 7 are each made up of an arm 15, a wire 16 soldered to one end side of the arm 15, and magnetic circuit forming members 17 welded to both side faces of the arm 15. Each armature 7 is supported pivotably by means of a pivot shaft 18 which is mounted on an opposite end side of the arm 15. The armature 7 is pivotable between a printing position and a stand-by position with the pivot shaft 18 as a center. As the armature 7 pivots between the printing position and the stand-by position, the wire 16, which is guided by the wire guide 8, performs a sliding motion. When the armature 7 pivotally reaches the printing position, a tip of the wire 16 strikes against printing paper to effect printing. At a front end portion of the front case 2 there is provided a tip guide 19 for holding the tip of each slidable wire 16 in a line in accordance with a predetermined pattern.

The pivotal motion of the armature 7 is performed by turning ON and OFF the supply of electric power to the associated coil 13. When the coil 13 is energized, the armature pivots to the printing position about the pivot shaft 18. FIG. 1 shows a state in which two armatures 7 illustrated therein have both pivoted to the printing position. When a coil 13 is de-energized, the associated armature 7 moves pivotally to the stand-by position (an abutting position against an armature stopper to be described below) with an urging force of an urging means (not shown).

An annular armature stopper 20 is mounted at a center of the rear case 6. The mounting of the armature stopper 20 to the rear case 6 is performed by fitting the armature stopper 20 into a mounting recess 21 formed in the rear case 6. When an armature 7 pivots from the printing position to the stand-by position, the arm 15 as part of the armature 7 comes into abutment against the armature stopper 20 and thus the armature stopper defines the stand-by position of the armature 7.

Figure 4:
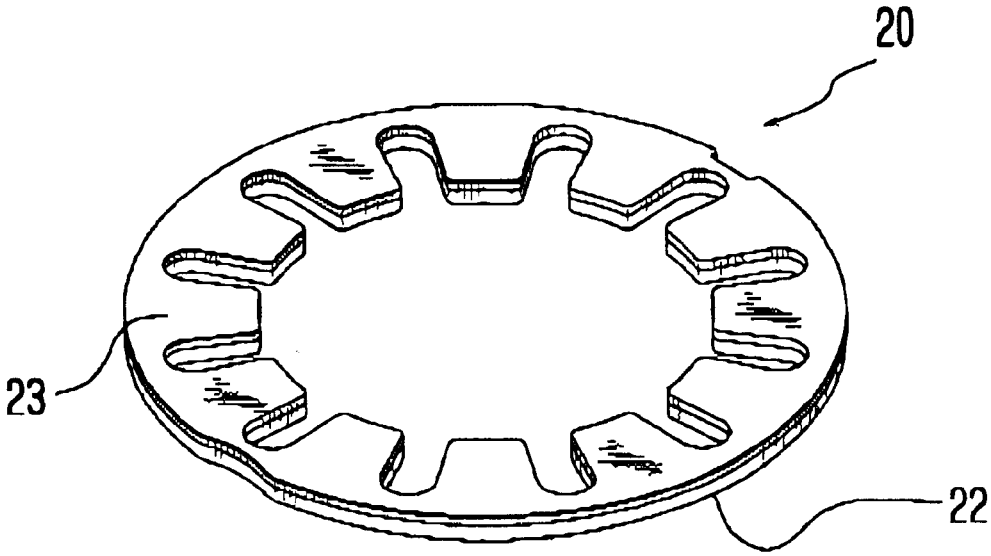
FIG. 4 is an enlarged perspective view of an armature stopper.

As shown in FIG. 4, the armature stopper 20 is formed by combining an elastic plate 22 formed of fluorine-containing rubber and a hard plate 23 integrally with each other, using a silane-based adhesive, the hard plate 23 being formed of SUS301 which is a metallic material difficult to undergo a plastic deformation. The elastic plate 22 and the hard plate 23 are formed at thicknesses of 0.20 mm and 0.06 mm, respectively. The armature stopper 20 is fabricated by bonding the elastic plate 22 which is a flat plate and the hard plate 23 which is also a flat plate with each other, using a silane-based adhesive, and by subsequently punching the resulting laminate from the hard plate 23 side.

Figure 5:
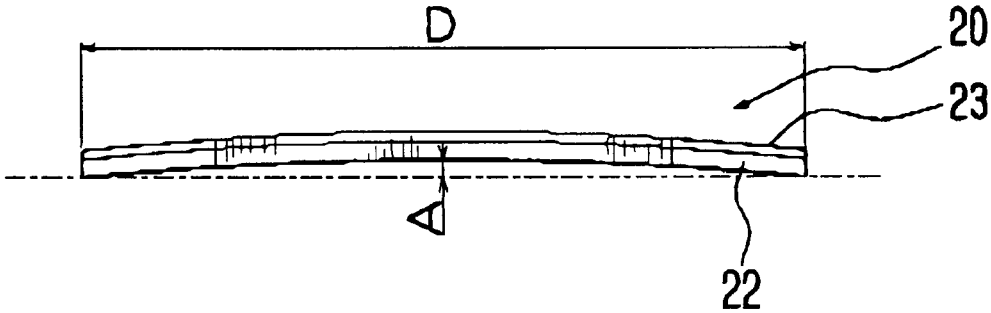
FIG. 5 is a sectional view of the armature stopper.

The elastic plate 22 made of fluorine-containing rubber and the hard plate 23 made of SUS301 are difficult to be bonded each other, but the use of a silane-based adhesive permits a satisfactory bonding of the two. The armature stopper 20 thus formed by punching the bonded laminate of the elastic plate 22 and the hard plate 23 is in a warped state such that its hard plate 23 side is convex. FIG. 5 shows this warp in an exaggerated manner. The amount of warp, A, of the armature stopper 20, whose diameter D is 11.6 mm, is about 1 mm from a reference plane (a flat surface).

It is presumed that the armature stopper 20 is warped by punching on the basis of the following mechanism. If punching is performed from the hard plate 23 side to form the armature stopper 20, the hard plate 23 does not undergo any change in thickness, but the elastic plate 22 is compressed by punching and becomes thin and is punched in this thin state. After the punching, the elastic plate 22 tends to revert to its original thickness and a force which acts to pull the hard plate 23 toward the center is exerted on the bonded portion between both plates and the armature stopper 20 is warped under the action of this force.

The fitting of the armature stopper 20 into the mounting recess 21 is performed in such a manner that the hard plate 23 faces the armature 7 side, that is, its side for abutment against the armature 7 becomes convex in shape.

Figure 3:
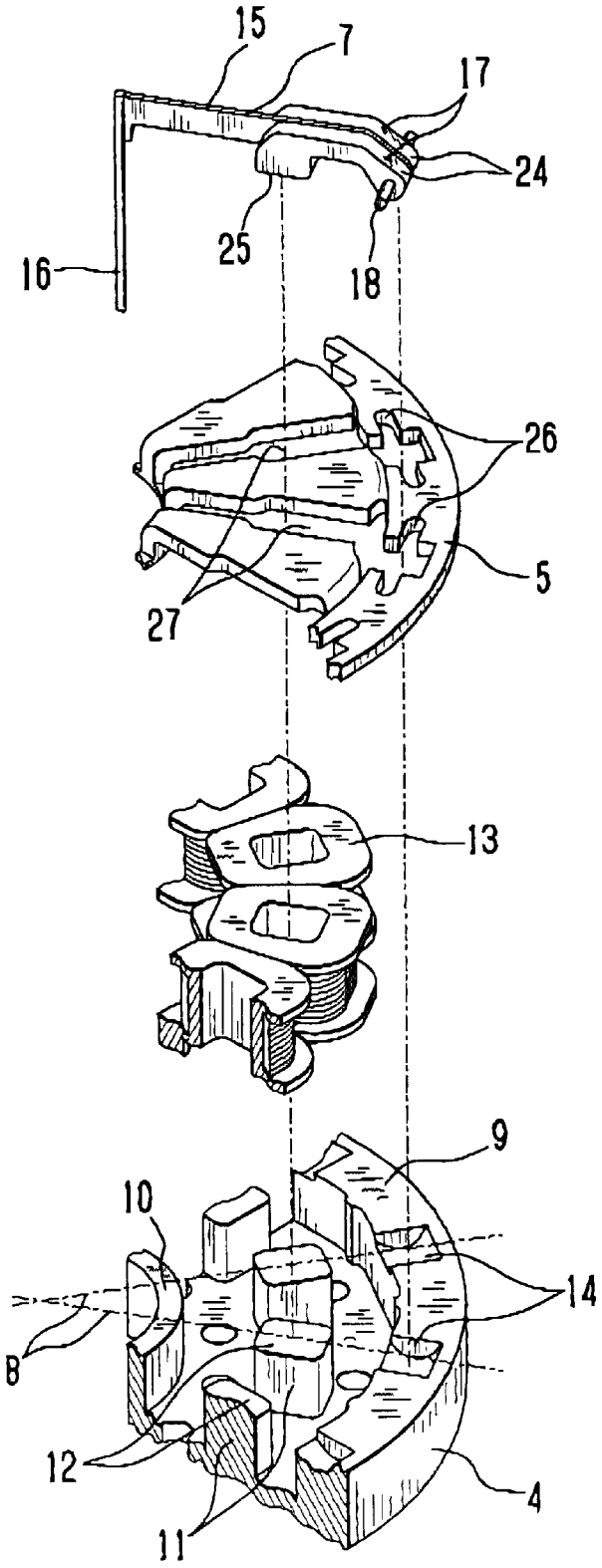
FIG. 3 is a partially cut-away exploded perspective view of a yoke and an armature spacer for explaining the armature support structure.

Detailed shapes of yoke 4, armature spacer 5, and armature 7 will now be described with reference to FIG. 3. The cores 11 formed on the yoke 4 are arranged radially with respect to the center of the yoke. The recesses 14 are arranged respectively on virtual straight lines B joining the center of the yoke 4 and the centers of the pole faces 12. The magnetic circuit forming members 17 of the armature 7 are formed of a magnetic material. The magnetic circuit forming members 17 are each formed with a supported portion 24 which is inserted into the associated recess formed in the yoke 4 and an attracted face 25 which is attracted by the pole face 12 of the associated core 11. The pivot shaft 18 is inserted removably through circular through holes (not shown) formed respectively in the supported portion 24 and the armature 15, and during pivotal motion of the armature 7 there occurs a sliding motion between inner periphery surfaces of the through holes and an outer periphery surface of the pivot shaft 18. Outer periphery portions on both end sides of the pivot shaft 18 are abutted against both side portions of the associated recess 14 formed in the upper surface of the outer periphery-side cylindrical portion 9.

The armature spacer 5 is provided for forming a space which permits the pivotal motion of the armatures between the yoke 4 and the rear case 6. The armature spacer 5 is formed with plural grooves 26 for positioning the pivot shafts 18 and plural guide grooves 27 for receiving the armatures 7 therein. The grooves 26 each establish an axial position and a position in a direction orthogonal to the axial direction of each pivot shaft 18 which comes into contact with the upper surface of the cylindrical portion 9.

As to the construction of the wire dot printer using the wire dot printer head 1 described above, it is already known, so only the principle thereof will here be described briefly. As to the other components than the wire dot printer head 1 which constitute the wire dot printer, explanations will be given with drawings thereof omitted. The wire dot printer head 1 is mounted on a carriage which is reciprocated along a platen. Printing paper is fed between the platen and the wire dot printer head 1 by conveying rollers. In case of using a pressure-sensitive color-developing paper as the printing paper, the paper develops color under the pressure of wire 16 which is driven, to effect printing. In case of using plain paper as the printing paper, the plain paper undergoes the pressure of wire 16 through an ink ribbon, whereby the ink of the ink ribbon is transferred onto the plain paper to effect printing.

When a certain coil 13 is energized during a printing operation by the wire dot printer, a magnetic circuit is formed among the core 11 on which the coil 13 is mounted, the magnetic circuit forming members 17 of the armature 7 opposed to the core 11, and the outer and inner periphery-side cylindrical portions 9, 10 of the yoke 4. As a result, the armature 7 moves pivotally about the pivot shaft 18 in a direction in which the attracted faces 25 of the magnetic circuit forming members 17 are attracted to the pole face of the core 11. The pivoted position of the armature 7 at this time is the printing position shown in FIG. 1, and as a result of a pivotal movement of the armature 7 to the printing position, the tip of wire 16 projects to the printing paper side to effect printing.

When the coil 13 is de-energized, the magnetism so far developed becomes extinct and the armature 7 moves pivotally about the pivot shaft 18 toward the stand-by position with an urging force of an urging member (not shown). When the armature 7 pivotally reaches the stand-by position, its arm 15 is put in abutment against the hard plate 23 of the armature. An impact force resulting from this abutment increases with an increase of printing speed and printing pressure.

Since the armature stopper 20 is warped so as to be convex on its abutting side against the armature 7, it deflects in the flattening direction just after abutment of the armature against the hard plate 23 of the armature stopper 20 which armature has pivoted to the stand-by position. With this deflecting motion, the impact force induced upon abutment of the armature 7 against the hard plate 23 is cushioned. Consequently, even if the abutment of the armature 7 against the hard plate 23 is repeated by the pivotal motion of the armature with printing operation, chipping and deformation of the hard plate 23 are suppressed and hence the durability of the armature stopper 20 is improved. Therefore, a change in printing stroke of the armature 7, which is caused by chipping or deformation of the armature, is suppressed, whereby the occurrence of variations in print timing or printing pressure for each wire 16, which is caused by a change in printing stroke, is suppressed and a high print quality is ensured over a long period.

Further, since the hard plate 23 and the elastic plate 22 are bonded together into an integral piece with no gap present therebetween, the impact inducted when the armature having pivoted to the stand-by position comes into abutment against the hard plate 23 can be absorbed in high efficiency. Consequently, it is possible to suppress vibrations of the hard plate 23 upon abutment of the armature 7 against the hard plate 23 and prevent the vibrations from being propagated to the other armatures 7. In the other armatures 7, therefore, there occurs neither variations in pivot timing nor variations in printing pressure both caused by propagation of vibrations from the hard plate 23, thus resulting in that the print quality becomes stable.

Further, since the hard plate 23 is bonded to the elastic plate 22, even in the event of breakage of the hard plate 22 due to repetition of its abutment with the armature 7, it is possible to prevent the scatter of broken hard plate pieces and hence prevent the wire dot printer head 1 from undergoing a heavy damage caused by the scatter of broken hard plate pieces.

Further, when fabricating the armature stopper 20 by bonding and punching the hard plate 23 and the elastic plate 22, since the punching is performed from the hard plate 23 side, even if an edge portion of the hard plate 23 is burred by the punching, the burr is oriented toward the elastic plate 22. Accordingly, even if the pivoting armature 7 strikes against the hard plate 23, the armature is prevented from striking against the burr of the hard plate 23 and the occurrence of cracking, etc. of the armature 7 or the hard plate 23 caused by collision of the armature with the burr can be prevented.

In the light of the above description it is obvious that many modifications and changes of the present invention may be made. Accordingly, it is understood that within the scope of the appended claims the present invention can be practiced in other modes than those described above concretely.

What is claimed is:

1. A wire dot printer head comprising:

an armature capable of moving pivotally between a printing position and a stand-by position;

a printing wire fixed to one end side of the armature and adapted to slide with the pivotal movement of the armature; and an armature stopper comprising an integrally bonded combination of an elastic plate and a hard plate, the armature stopper being disposed in a position and a direction in which the armature comes into abutment against the hard plate when the armature has pivoted to the standby position, the armature stopper being warped so as to be convex on its side on which the armature comes into abutment against the hard plate.

2. A wire dot printer head according to claim 1, wherein the armature stopper is warped convexly by application of a force exerted on a bonded portion between the elastic plate and the hard plate, which force acts to pull the hard plate toward the center.

3. A wire dot printer head according to claim 1, wherein the hard plate is formed of SUS301.

4. A wire dot printer head according to claim 2, wherein the hard plate is formed of SUS301.

5. A wire dot printer head according to claim 1, wherein the elastic plate is formed of fluorine-containing rubber.

6. A wire dot printer head according to claim 2, wherein the elastic plate is formed of a fluorine-containing rubber.

7. A wire dot printer head according to claim 1, wherein the hard plate and the elastic plate are bonded together with a silane-based adhesive.

8. A wire dot printer head according to claim 2, wherein the hard plate and the elastic plate are bonded together with a silane-based adhesive.

9. A wire dot printer head according to claim 1, wherein the amount of warp of the armature stopper is not larger than 1 mm from a reference plane.

10. A wire dot printer head according to claim 2, wherein the amount of warp of the armature stopper is not larger than 1 mm from a reference plane.

11. A wire dot printer head according to claim 1, wherein the hard plate is formed of SUS301 and the elastic plate is formed of fluorine-containing rubber.

12. A wire dot printer head according to claim 2, wherein the hard plate is formed of SUS301 and the elastic plate is formed of fluorine-containing rubber.

13. A wire dot printer head according to claim 1, wherein the hard plate is formed of SUS301, the elastic plate is formed of fluorine-containing rubber, and the amount of warp of the armature stopper is not larger than 1 mm from a reference plane.

14. A wire dot printer head according to claim 2, wherein the hard plate is formed of SUS301, the elastic plate is formed of fluorine-containing rubber, and the amount of warp of the armature stopper is not larger than 1 mm from a reference plane.

15. A wire dot printer head according to claim 1, wherein the hard plate is formed of SUS301, the elastic plate is formed of fluorine-containing rubber, and the hard plate and the elastic plate are bonded together with a silane-based adhesive.

16. A wire dot printer head according to claim 2, wherein the hard plate is formed of SUS301, the elastic plate is formed of fluorine-containing rubber, and the hard plate and the elastic plate are bonded together with a silane-based adhesive.

17. A wire dot printer head according to claim 1, wherein the hard plate is formed of SUS301, the elastic plate is formed of fluorine-containing rubber, the hard plate and the elastic plate are bonded together with a silane-based adhesive, and the amount of warp of the armature stopper is not larger than 1 mm from a reference plane.

18. A wire dot printer head according to claim 2, wherein the hard plate is formed of SUS301, the elastic plate is formed of fluorine-containing rubber, the hard plate and the elastic plate are bonded together with a silane-based adhesive, and the amount of warp of the armature stopper is not larger than 1 mm from a reference plane.

* * * * *